US007798810B2

(12) United States Patent
Li

(10) Patent No.: US 7,798,810 B2
(45) Date of Patent: Sep. 21, 2010

(54) HIGH PRESSURE HOT GAS GENERATING DEVICE

(76) Inventor: Kuan-Lun Li, 235 Chung-Ho Box 8-24, Taipei (TW)

( * ) Notice: Subject to any disclaimer, the term of this patent is extended or adjusted under 35 U.S.C. 154(b) by 261 days.

(21) Appl. No.: 11/946,873

(22) Filed: Nov. 29, 2007

(65) Prior Publication Data

US 2009/0139465 A1 Jun. 4, 2009

(51) Int. Cl.
*F27D 3/00* (2006.01)

(52) U.S. Cl. ..... 432/239; 122/5

(58) Field of Classification Search ..... 432/58, 432/95, 239; 122/4 D, 5, 7 R; 60/39.07, 60/39.08; 110/245, 236, 235
See application file for complete search history.

(56) References Cited

U.S. PATENT DOCUMENTS 4,255,115 A * 3/1981 Graat et al. ..... 431/10
4,265,670 A * 5/1981 Brachthauser et al. ..... 106/756
4,457,289 A * 7/1984 Korenberg ..... 122/4 D
4,469,050 A * 9/1984 Korenberg ..... 122/4 D
4,550,669 A * 11/1985 Foresto ..... 110/245
4,598,541 A * 7/1986 Mori et al. ..... 60/784
5,370,065 A * 12/1994 Christensen ..... 110/346
5,595,482 A * 1/1997 Parsons ..... 432/95
5,738,511 A * 4/1998 Borah et al. ..... 432/95
5,919,038 A * 7/1999 Labelle et al. ..... 432/14

* cited by examiner

*Primary Examiner*—Gregory A Wilson

(57) ABSTRACT

A high pressure hot gas generating device comprises a combustion furnace; an interior of the combustion furnace having a combustion chamber; a lower side of the combustion furnace having an ash exhausting opening; an upper side of the combustion furnace having a high pressure hot gas output tube; a fuel transfer mechanism installed at one side of the combustion furnace and inserted into the combustion chamber for providing solid fuel to the combustion chamber of the combustion furnace; the fuel transfer mechanism can adjust the speed and amount of the solid fuel entering into the combustion chamber; and an air inlet unit installed at one side of the combustion furnace and inserted into the combustion chamber for supplying air to the combustion chamber to be used in the initial ignition; and an ignition unit.

1 Claim, 1 Drawing Sheet

HIGH PRESSURE HOT GAS GENERATING DEVICE

FIELD OF THE INVENTION

The present invention relates to hot gas generators, and particularly to a high pressure hot gas generating device, wherein high pressure hot gas from the present invention can be used as a power for driving a vehicle, a water pump, an alternative current generator, etc., while it has a simple structure than the prior art structures. Furthermore the structure of the present invention is compact, light and safer, it has a higher efficiency.

BACKGROUND OF THE INVENTION

Currently, high pressure gas generators (such as a vapor boiler) use diesel oil, heavy oil, coal, charcoal, etc. to heat water so as to generate vapor. Then the heat energy from the vapor is used to drive a machine (such as a gas turbine, a generator, etc.). The prior art high pressure gas generators have complicated structure, and a bulge volume, and is difficult to be maintained. Furthermore the fuels used (such as diesel oil, heavy oil, coal, charcoal, etc.) are low efficiency so that some energy is lost.

SUMMARY OF THE INVENTION

Accordingly, the primary object of the present invention is to provide a high pressure hot gas generating device, in that high pressure hot gas from the present invention can be used as a power for driving a vehicle, a water pump, an alternative current generator, etc., while it has a simpler structure than the prior art structures. Furthermore the structure of the present invention is compact, light and safer with the function of high efficiency.

To achieve above objects, the present invention provides a high pressure hot gas generating device comprising: a combustion furnace; an interior of the combustion furnace having a combustion chamber; a lower side of the combustion furnace having an ash exhausting opening; an upper side of the combustion furnace having a high pressure hot gas output tube; a fuel transfer mechanism installed at one side of the combustion furnace and inserted into the combustion chamber for providing solid fuel to the combustion chamber of the combustion furnace; the fuel transfer mechanism can adjust the speed and amount of the solid fuel entering into the combustion chamber; and an air inlet unit installed at one side of the combustion furnace and inserted into the combustion chamber for supplying air to the combustion chamber to be used in the initial ignition; an ignition unit. In actuating the combustion furnace, the fuel transfer mechanism supplies little solid fuel to the combustion chamber of the combustion furnace; the air inlet unit supplies air to the combustion chamber of the combustion furnace; then the ignition unit will ignite the solid fuel and then the ignition unit stops, next, the feeding speed and amount of the solid fuel from the fuel transfer mechanism to the combustion chamber 11 and the amount of air from the air inlet unit are adjusted to have desired heat energy; and then high pressure hot gas is outputted from the high pressure hot gas output tube to drive a machine; then the machine can further drive other object.

The various objects and advantages of the present invention will be more readily understood from the following detailed description when read in conjunction with the appended drawing.

DETAILED DESCRIPTION OF THE INVENTION

Figure 1:
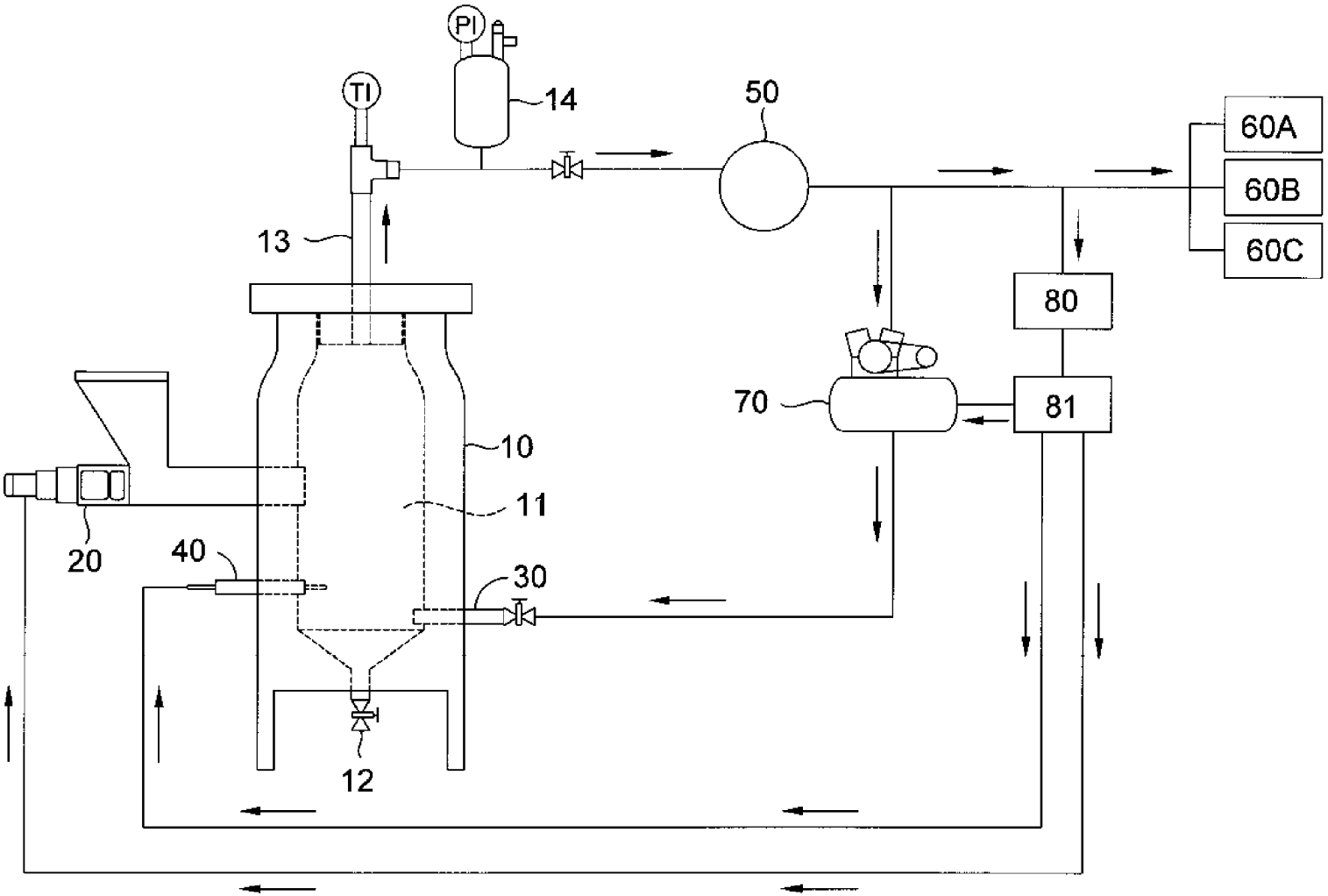
FIG. 1 is a schematic view about the structure of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIG. 1, the high pressure hot gas generating device of the present invention is illustrated. The present invention has the following elements.

A combustion furnace 10 is a pressure and fire tolerable and heat preserving device and is a stand device. An interior of the combustion furnace 10 has a combustion chamber 11. A lower side of the combustion furnace 10 has an ash exhausting opening 12. An upper side of the combustion furnace 10 has a high pressure hot gas output tube 13. Preferably, the high pressure hot gas output tube 13 is formed with a hot air pressure storage tank 14.

A fuel transfer mechanism 20 (referring to FIG. 1) is installed at one side of the combustion furnace 10 and is inserted into the combustion chamber 11 for providing solid fuel (such as coal, charcoal, etc.) to the combustion chamber 11 of the combustion furnace 10. The fuel transfer mechanism 20 can adjust the speed and amount of the solid fuel entering into the combustion chamber 11.

An air inlet unit 30 (referring to FIG. 1) is installed at one side of the combustion furnace 10 and is inserted into the combustion chamber 11 for supplying air to the combustion chamber 11 to be used in the initial ignition.

An ignition unit 40 is included.

By above mentioned structure, in initial actuation, the fuel transfer mechanism 20 supplies little solid fuel (such as coal, charcoal, etc.) to the combustion chamber 11 of the combustion furnace 10. The air inlet unit 30 supplies air to the combustion chamber 11 of the combustion furnace 10. Then the ignition unit 40 will ignite the solid fuel and then the ignition unit 40 stops. Next, the feeding speed and amount of the solid fuel from the fuel transfer mechanism 20 to the combustion chamber 11 and the amount of air from the air inlet unit 30 are adjusted to have desired heat energy. Then high pressure hot gas is outputted from the high pressure hot gas output tube 13 to drive a machine (referring to FIG. 1, such as the gas turbine 50). Then the machine can further drive a vehicle 60A, a water pump 60B, or an alternative current generator 60C, etc.

In one preferred application, the high pressure gas from the combustion chamber 11 drives a turbine 50 through a high pressure hot gas output tube 13. Then the turbine 50 drives an air compressor 70 to provide air to the air inlet unit 30.

In another preferred application, other than driving the turbine 50, the turbine 50 further drives a direct current generator 80 to operate and the direct current is stored in a battery set 81 for being used to actuate fuel transfer mechanism 20, ignition unit 40 and the air compressor 70 when the combustion furnace 10 is actuated next time.

Thus, from above discussion, it is known, that the high pressure hot gas from the present invention can be used as a power for driving a vehicle 60A, a water pump 60B, an alternative current generator 60C, etc., while it has a simpler structure than the prior art structures. Furthermore the structure of the present invention is compact, light and safer with the function of high efficiency.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A high pressure hot gas generating device, comprising:

a combustion furnace; an interior of the combustion furnace having a combustion chamber; a lower side of the combustion furnace having an ash exhausting opening; an upper side of the combustion furnace having a high pressure hot gas output tube;

a fuel transfer mechanism installed at one side of the combustion furnace and inserted into the combustion chamber for providing solid fuel to the combustion chamber of the combustion furnace; the fuel transfer mechanism can adjust the speed and amount of the solid fuel entering into the combustion chamber; and an air inlet unit installed at one side of the combustion furnace and inserted into the combustion chamber for supplying air to the combustion chamber to be used in the initial ignition;

an ignition unit; and wherein in actuating the combustion furnace, the fuel transfer mechanism supplies little solid fuel to the combustion chamber of the combustion furnace; the air inlet unit supplies air to the combustion chamber of the combustion furnace; then the ignition unit will ignite the solid fuel and then the ignition unit stops; next, the feeding speed and amount of the solid fuel from the fuel transfer mechanism to the combustion chamber and the amount of air from the air inlet unit are adjusted to have desired heat energy; and then high pressure hot gas is outputted from the high pressure hot gas output tube to drive a machine;

then the machine can further drive other object; and wherein the high pressure hot gas output tube is formed with a hot air pressure storage tank; and wherein the high pressure gas from the combustion chamber drives a turbine through a high pressure hot gas output tube; and then the turbine drives an air compressor to provide air to the air inlet unit; and wherein the turbine further drives a direct current generator to operate and the direct current is stored in a battery set for being used to actuate fuel transfer mechanism, the ignition unit and the air compressor when the combustion furnace is actuated next time.

* * * * *